United States Patent [19]

Tang

[11] Patent Number: 4,606,295

[45] Date of Patent: Aug. 19, 1986

[54] MECHANICAL DOOR CHIME POWERED BY MOTION OF THE DOOR

[76] Inventor: Kam Y. Tang, 548 Wyandotte Ave., Daly City, Calif. 94104

[21] Appl. No.: 579,500

[22] Filed: Feb. 13, 1984

[51] Int. Cl.[4] ..... G08B 3/02

[52] U.S. Cl. ..... 116/100; 116/141

[58] Field of Search ..... 116/93, 100, 282, 141, 116/148; 185/40 R, 40 A, 44, 39

[56] References Cited

U.S. PATENT DOCUMENTS

| | | | |
|---|---|---|---|
| 312,806 | 2/1885 | Bruen | 116/93 |
| 378,317 | 2/1888 | Iske | 116/93 |
| 414,124 | 10/1889 | Rockwell | 116/93 |
| 430,040 | 6/1890 | Rockwell | 116/100 |
| 492,070 | 2/1893 | Van Wormer | 116/100 |
| 755,568 | 3/1904 | Fuller | 116/100 |
| 4,098,221 | 7/1978 | Mickelson | 116/282 |

*Primary Examiner*—Charles Frankfort

*Assistant Examiner*—Denis E. Corr

*Attorney, Agent, or Firm*—Hamrick, Hoffman, Guillot & Kazubowski

[57] ABSTRACT

A mechanical door chime powered by movement of a pivoting door in a frame includes means for mechanically storing energy, means for producing sound operatively coupled to the output of the energy storing means, a rigid inclined surface coupled to the door or its frame, a base mounted proximate the pivoting junction between the door and its frame opposite the surface with a rigid plunger having a rotating contact arbored at one end, where the plunger is restrained to slide rectilinearly in said base, the rotating contact at it's end abutting against the rigid surface coupled to the door as the door pivots open causing linear movem ent of the plunger relative to the base as the door is opened, and means coupling the plunger to the energy storing means for energizing the energy storing means responsive to the liner movement of the plunger.

8 Claims, 7 Drawing Figures

MECHANICAL DOOR CHIME POWERED BY MOTION OF THE DOOR

DESCRIPTION OF THE PRIOR ART

1. Field of Invention

This invention relates to audible door chimes powered by movement of a pivoting door.

2. Background of the Invention

Various forms of devices are presently used to announce the arrival of visitors. The simplest of these devices is the door knocker which is hit against a striker plate by the visitor. The result is a harsh and startling sound. Conventionally, an electrical circuit actuated by pushing a button or by breaking a light beam energizes a sound producing apparatus such as a bell or musical chime. Such systems may avoid the harsh and startling sound of a door knocker but require an electrical power source such as a battery or household electrical current.

A primary object of this invention is to provide an unobtrusive and melodious mechanical door chime which is automatically powered by movement of a pivoting door alleviating the need for electrical power.

SUMMARY OF INVENTION

A device for storing mechanical energy e.g., a spring motor is coupled to a sound producing apparatus (music box). The spring motor is energized by a mechanical coupling driven by movement of a door as it pivots to the open position. One embodiment includes a latching mechanism for releasing the stored energy.

DETAILED DESCRIPTION OF THE INVENTION

The preferred embodiment of the invention includes an attractively finished base mounted on a door or door frame adjacent to the hinged edge of the door. Extending from the base is a slideably mounted plunger having a roller mounted on the extending end. A triangular shaped cam plate is mounted on the structure opposite the hinge from the base. When the base is mounted on the door frame, the cam plate is mounted on the door or vice versa. The roller edge of the plunger contacts the cam plate causing the plunger to slide relative to the base as the door is opened. This sliding motion of the plunger is converted to rotary motion and used to wind a a speed governed spring motor mounted in the base. The output shaft of the spring motor is drivingly connected to a suitable bell, chime or music box mounted within the base. Opening the door will wind the spring motor causing the bell, chime or music box to operate.

In an alternate embodiment, a latching type spring motor may be used whereby a visitor may announce his presence by releasing the spring motor to drive the music box or chime without opening the door.

Figure 1:
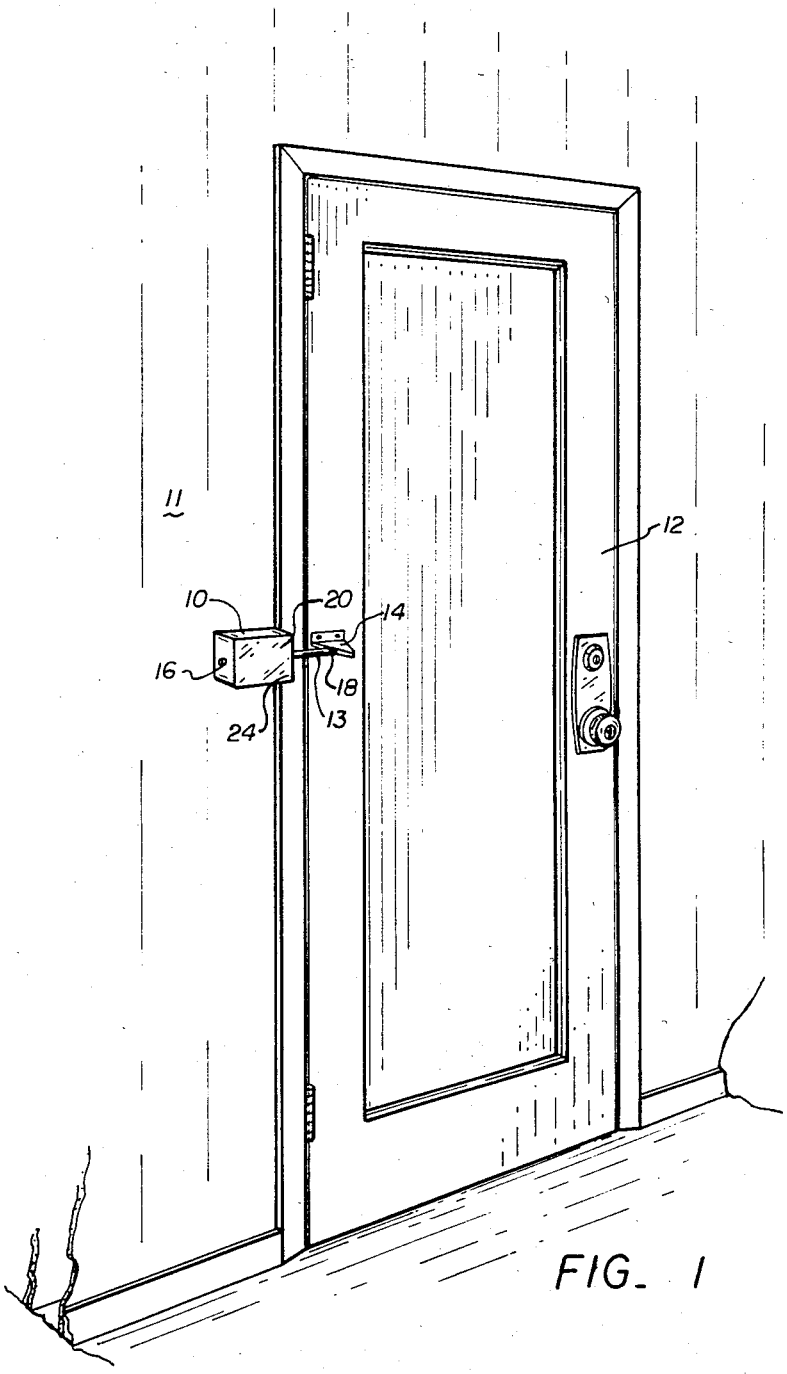
FIG. 1 is an isometric view of a typical door from inside a house or similar structure.

In more detail, referring to FIG. 1, the components of the device are shown mounted on a typical residential door installation. The base 10 is an attractively finished box structure mounted on the door frame 11 proximate to the hinged edge of the door 12. A bar plunger 13 is slideably mounted in the case 10 with its axis parallel to the door frame 11 and perpendicular to the pivoting axis of the door 12.

A triangular-shaped cam plate 14 either mounted or resting on the surface of the door 12 near its hinged edge extends outward from the door for abuttment with the extending end 16 of the plunger 13.

Referring now to FIGS. 1–5, the plunger 13 is a bar having a square cross section. Coaxial apertures 15 and 16 cut through the two vertical sides of the base receive and provide bearing surfaces for slideably supporting the plunger 13. The square cross section of the plunge prevents it from rotating. The extended end of the plunger 13 is forked. A vertical pin 17 and roller 18, are mounted between the forks such that the axis of rotation of the roller 18 is parallel to the pivoting axis of the door. The cam plate 14 provides an inclined surface which abuts against the roller as the door pivots from fully closed to the fully open position.

Figure 2:
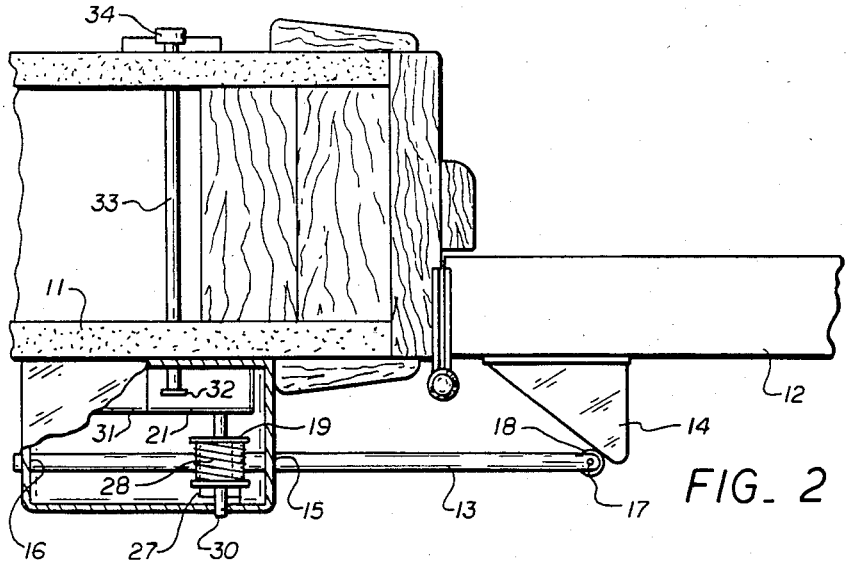
FIG. 2 is an enlarged fragmentary plan view of the hinged portion of the door with the door in the closed position and the plunger of the device in the extended position.
Figure 3:
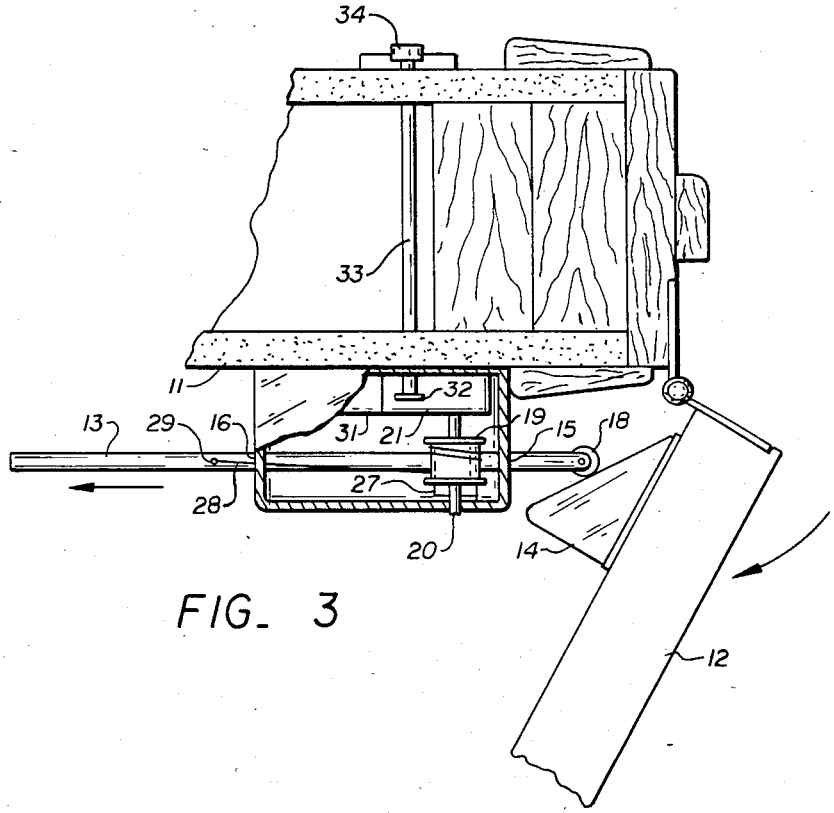
FIG. 3 is a view similar to FIG. 2 illustrating the door in the open position and the plunger of the device in the retracted position.
Figure 5:
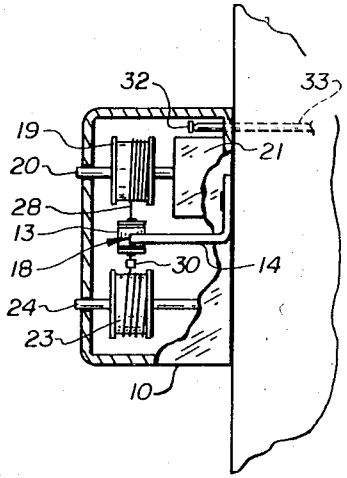
FIG. 5 is a fragmentary side view showing the side of the base which is closest to the hinged edge of the door.
Figure 4:
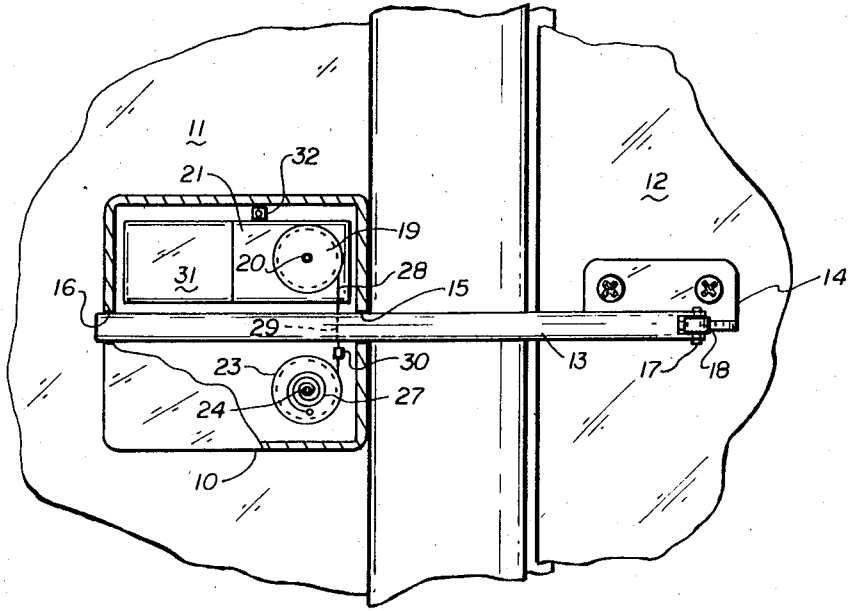
FIG. 4 is a fragmentary elevation view showing the front of the base and the components contained within it.

In particular referring FIGS. 2 and 3 as the door pivots open, roller 18 rolls on the inclined surface defined by the cam plate 14 causing the plunger 13 to slide axially in apertures 15 and 16 through the base. The roller 18 reduces friction between the cam plate 14 and the plunger 13, prevents galling of either component and prevents the plunger 13 from binding between the aperatures.

A power drum 19 is secured above the plunger 13 on the end of a rotatably mounted shaft 20 oriented perpendicularly with respect to the axis of the plunger 13. The shaft 20 is drivingly connected to a speed-governed spring motor 21.

A take-up reel is secured below the plunger 13 to a rotatably mounted shaft 24 parallel to the power drum shaft 20. A torsion spring 27 is connected between the take-up reel 23 and the base 10, thereby creating a torsional bias on the take-up reel 23.

Connecting the power drum 19 and take-up reel 23 is a cord 28. The cord is attached and wound around the circumferential surface of the power drum 19. The number and direction of the turns of cord 28 on the power drum 19 will be described later. The cord 28 passes through an aperture 29 through the plunger 13. The aperture 29 is located such that its vertical axis is tangentially aligned with the circumferential edge of the power drum 19 when the plunger 13 is fully extended (door closed). The free end of the cord 28 is attached to the circumferential surface of the of the take-up reel 23 at a point directly below the aperture 29.

The torsion spring 27 connected between the take-up reel 23 and the stationary base 10 maintains a torque on the take-up reel 23 for rotating the take-up reel 23 until stopped by tension of the cord 28. Accordingly the take-up reel will wind up any slack in the cord 28.

When the plunger 13 is in the fully-extended position, (door closed) the cord 28 assumes a nearly straight line from the power drum 19 through the aperture 29 to the take-up reel 23. Movement of the plunger 13 toward the retracted position causes the take-up reel 23 to rotate against the torque provided by torsion spring 27. The combination of the power drum 19, the cord 28, the aperture 29 and the take-up reel 23 maintain the plunger 13 in a normally extended position.

A stopper 30 having a diameter larger than the aperture 29 is secured to the cord 28 below the plunger 13. The stopper 30 limits the length of cord 29 which can slide through the aperture 29. The stopper 30 may be a piece of malleable metal firmly press-fit on the cord 28 or simply a knot tied in the cord 28. Ideally, the stopper 30 should be positioned immediately below the aperture 29 when the plunger 13 is in its normally extended position.

Linear translation of the plunger 13 upon opening the door 12 causes the cord 28 to slide through the aperture 29 until the stopper 30 hits the aperature 29, whereupon any additional linear translation unwinds the cord 28 from and rotates the power drum 19. The power drum 19 rotably drives a speed-governed spring motor 21.

The speed-governed spring motor 21 is a spring-actuated device similar to those used in wind-up toys or music boxes. Typically such devices include a latching mechanism for maintaining tension in a torsion spring coupled for rotating a shaft. A speed-governing mechanism (not shown) typically prevents the shaft from exceeding a set rotational speed as the spring unwinds. For example a speed governing mechanism may include weights pivotally mounted on a rotating disc which frictionally engage and rub on a drum with a force proportional to speed.

Rotation of power drum 19 as the plunger 13 translates to its retracted position winds the spring motor. The spring motor 21 in turns drives a sound-producing apparatus 31 such as a bell, chime or music box. The speed-governing mechanism in the spring motor is not essential depending upon the sound-producing apparatus selected but may be highly desirable. For example, where the sound-producing apparatus 31 is a music box, a speed-governing function will provide the necessary timing to the musical tune.

In one embodiment, a latching mechanism 32 on the spring motor is connected by linkage 33 to the door chime button 34 mounted on the exterior side of the door frame 11. Actuation of the door chime button 35 by a visitor will unlatch the speed-governed spring motor 21, and provided the spring motor is in the wound condition, the sound-producing apparatus 31 will be actuated until the energy in the spring motor 21 is depleted.

Alternatively, the latching mechanism on the spring motor can be eliminated. In this instance actuation of the door chime or music box occurs upon opening of the door. In effect, the mechanism gives musical notice that the door is being opened.

As the speed-governed spring motor 21 unwinds, the power drum 19 being directly connected to the spring motor 21, is rotated in the direction opposite to that when it was rotated by the sliding plunger 13. This action rewinds the cord on the power drum 19 until the stopper 30 comes in contact with the plunger 13. The mechanism is thus prepared to rewind the spring motor 21 when the door 12 is subsequently opened.

The direction and number of turns of cord 28 on the power drum 19 as well as the diameter of the power drum 19 are selected to be compatible with the maximum linear movement of the plunger 13 and the characteristics of the spring motor 21. Specifically, the direction of turns is chosen such that movement of the plunger 13 from the extended position to the retracted position rotates the power drum 19 in a direction which winds the spring motor 21. The number of turns is selected such that at least one turn of cord 28 remains on the drum 19 when the plunger 13 is in the fully-retracted position. The diameter of the power drum 19 is selected such that a translation of the plunger 13 from the fully-extended to the fully-retracted position winds the spring motor 21 to near capacity.

Figure 7:
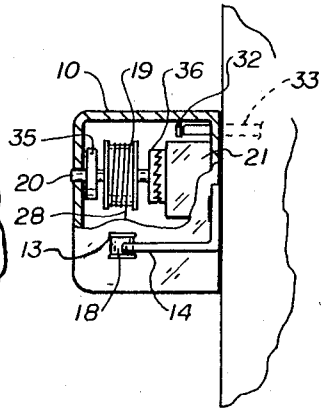
FIG. 7 is a fragmentary side view similar to FIG. 5 showing the embodiment of the modification illustrated in FIG. 6.
Figure 6:
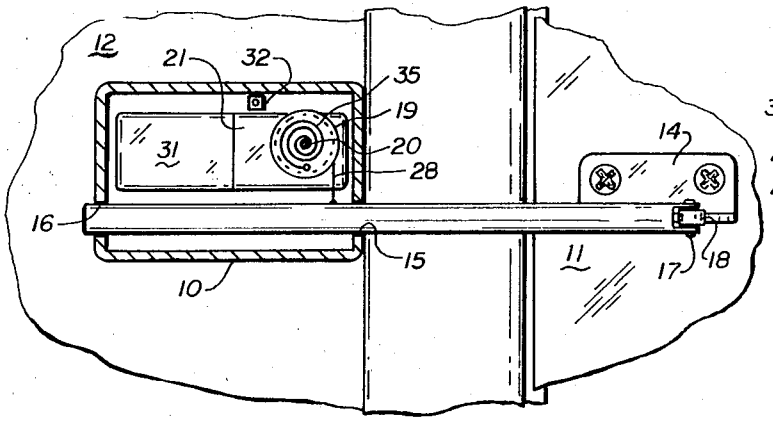
FIG. 6 is a fragmentary elevation view similar to FIG. 4 showing a modification of the connecting means between the power drum and the speed governed spring motor.

FIGS. 6 and 7 illustrate an alternative embodiment of the invention in which multiple travels of the plunger 13 wind the spring motor 21. In this embodiment the base 10 is mounted on the door 12, and the cam plate 14 is mounted on the door frame 11. A torsion spring 35 is connected between the power drum 19 and the base 10 for rotating the power drum in a direction for windng up the cord 28. The power drum 19 drives a spring motor 21 through a torque-limiting, uni-directional clutch 36. Movement of the plunger 13 from the extended position to the retracted position as the door 12 opens rotates the power drum 19 for winding the spring motor 21. The torsion spring 35 rewinds the cord 28 on the drum 19 and urges the plunger 13 to its normally extended position. Accordingly, each opening of the door 12 will partially wind the spring motor 21 until it is fully wound at which time the torque limiting function of the clutch 36 will disengage the power drum 19 from from the spring motor 21. The clutch 36 also disengages the rotation of the spring motor from the power drum.

In the above embodiment, the cord 28 is directly attached to the fully-extended plunger 13 at a point vertically below the edge of the power drum 19. The cord tangentially leaves the power drum. Also, the spring motor may include a latching mechanism which prevents it from unwinding until it is tripped.

It should be appreciated that many modifications and variations to the particular embodiments of the invention described and illustrated herein may readily occur to those skilled in the art with out departing from the spirit and scope of the invention as described in the following claims.

I claim:

1. A mechanical door chime powered by movement of a pivoting door in a frame comprising in combination, (a) means for mechanically storing energy having an input and an output, (b) means for producing sound operatively coupled to the output of the eneergy storing means, (c) a surface rigidly coupled to the door, (d) a base mounted proximate a pivoting junction between the door and its frame, (e) a rigid plunger with a rotatable contact arbored at one end, the plunger being slideable restrained to rectilinear motion in said base with the end of the plunger extending to abut the rotatable contact against the surface rigidly coupled to the door as the door pivots open causing linear movement of the plunger reletive to the base as the door is opened, and (f) a means coupling the plunger to the energy storing means for energizing the energy storing means responsive to the liner movement of the plunger.

2. A mechanical door chime powered by movement of a pivoting door in a frame comprising in combination, (a) means for mechanically storing energy having an input and an output, (b) means for producing sound operatively coupled to the output of the eneergy storing means, (c) a surface rigidly coupled to the frame, (d) a base mounted on the door proximate a pivoting junction between the door and its frame, (e) a rigid plunger with a rotatable contact arbored at one end, the plunger being slideable restrained to rectilinear motion in said base with the end of the plunger extending to abut the rotatable contact against the surface rigidly coupled to the frame as the door pivots open causing linear movement of the plunger reletive to the base as the door is opened, and (f) a means coupling the plunger to the energy storing means for energizing the energy storing means responsive to the liner movement of the plunger.

3. The mechanical door chime of claims 1 or 2 wherein the rigidly coupled surface is provided by a cam plate positioned to provide a surface angularly extending outwardly from a plane parallel the door.

4. The mechanical door chime of claim 3 wherein the means for mechanically storing energy comprises a spring moter having an input shaft, an output shaft and a torsion spring connected between the respective shafts, and wherein the means coupling the plunger to the energy storing means rotates the input shaft for winding the torsion spring; the torsion spring unwinding to rotate the output shaft for powering the the sound producing means.

5. The mechanical door chime of claim 4 wherein the means for mechanically storing energy further includes, (a) a normally latched release mechanism coupled to the output shaft for preventing it from powering the sound producing means, (b) a push button linked to the release mechanism for decoupling it from the output shaft when depressed, whereupon the output shaft powers the sound producing means.

6. The mechanical door chime of claim 3 wherein the means coupling the plunger to the energy storing means further includes, (a) a power drum rotatably mounted in the base for rotating the input of the energy storing means, and (b) a cord wound around said power drum with one end connected to the surface of said power drum, its remaining end being connected to the plunger.

7. The mechanical door chime of claim 6 wherein the means coupling the plunger to the energy storing means further includes, (a) a uni-directional, torque-limiting clutch drivingly connected between the power drum and the energy storing means, (a) a torsion spring connected between the base and the power drum for rotating the power drum in a direction to wind up said cord.

8. The mechanical door chime of claim 6 wherein the means coupling the plunger to the energy storing means further includes, (a) a power-drum rotatably mounted in the base for rotating the input of the energy storing means, (b) a take-up reel rotatably mounted in the base, (c) a cord having on end connected to the surface of said power drum, being wound around the power drum, slideably passing through an aperture defined through the plunger with its remaining end being attached to the surface of said take-up reel, (d) a stopper secured to the cord between the plunger and the take-up reel, (e) a torsion spring connected between the base and the take-up reel for rotating said take-up reel in a direction to wind up the cord.

* * * * *